US011898575B2

(12) United States Patent
Li et al.

(10) Patent No.: US 11,898,575 B2
(45) Date of Patent: Feb. 13, 2024

(54) HOUSING OF CENTRIFUGAL FAN, CENTRIFUGAL FAN AND CLOTHES DRYER

(71) Applicants: QINGDAO HAIER DRUM WASHING MACHINE CO., LTD., Qingdao (CN); Haier Smart Home Co., Ltd., Qingdao (CN)

(72) Inventors: Tao Li, Qingdao (CN); Long Yang, Qingdao (CN); Jindong Bing, Qingdao (CN); Quan Liang, Qingdao (CN); Dongdong Zhu, Qingdao (CN); Zhenjia Chu, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 205 days.

(21) Appl. No.: 17/603,113

(22) PCT Filed: Apr. 8, 2020

(86) PCT No.: PCT/CN2020/083765

§ 371 (c)(1),
(2) Date: Oct. 12, 2021

(87) PCT Pub. No.: WO2020/207409

PCT Pub. Date: Oct. 15, 2020

(65) Prior Publication Data

US 2022/0196033 A1 Jun. 23, 2022

(30) Foreign Application Priority Data

Apr. 12, 2019 (CN) ..... 201910295495.8
Apr. 12, 2019 (CN) ..... 201910296045.0
Apr. 12, 2019 (CN) ..... 201910296046.5

(51) Int. Cl.
*F04D 29/42* (2006.01)
*F04D 17/16* (2006.01)
(Continued)

(52) U.S. Cl.
CPC ..... *F04D 29/4226* (2013.01); *F04D 17/16* (2013.01); *F04D 29/441* (2013.01); *F04D 29/667* (2013.01); *D06F 58/20* (2013.01)

(58) Field of Classification Search
CPC .... F04D 29/4226; F04D 17/16; F04D 29/441; F04D 29/667; F04D 29/422; D06F 58/20
See application file for complete search history.

(56) References Cited

FOREIGN PATENT DOCUMENTS

CN 207568894 U 7/2018
CN 108457897 A 8/2018
(Continued)

OTHER PUBLICATIONS

International Search Report dated Jul. 9, 2020 in corresponding International application No. PCT/CN2020/083765; 4 pages.

*Primary Examiner* — Jacob M Amick
*Assistant Examiner* — Charles J Brauch
(74) *Attorney, Agent, or Firm* — Maier & Maier, PLLC

(57) ABSTRACT

A housing of a centrifugal fan, a centrifugal fan and a clothes dryer; a layered structure is provided within an air duct of the housing, and the layered structure is configured to be able to divide at least a part of the air duct into at least two air layers, the width of an air layer close to a strong air end being greater than the width of an air layer close to a weak air end. Also disclosed are a centrifugal fan having the housing and a clothes dryer having the centrifugal fan. By the layered structure being disposed within the air duct, the air duct is divided into at least two air layers, and the width of the wind layer close to the strong wind end is greater than the width of the wind layer close to the weak wind end.

14 Claims, 4 Drawing Sheets

(51) Int. Cl.

| | |
|---|---|
| ***F04D 29/44*** | (2006.01) |
| ***F04D 29/66*** | (2006.01) |
| ***D06F 58/20*** | (2006.01) |

(56) References Cited

FOREIGN PATENT DOCUMENTS

| | | | | | |
|---|---|---|---|---|---|
| CN | 208185066 | U | * | 12/2018 | ..... F04D 29/422 |
| CN | 208185066 | U | | 12/2018 | |
| CN | 210118284 | U | | 2/2020 | |
| JP | 2006152936 | A | | 6/2006 | |

* cited by examiner

HOUSING OF CENTRIFUGAL FAN, CENTRIFUGAL FAN AND CLOTHES DRYER

FIELD

The present disclosure belongs to the technical field of fans, and specifically provides a housing of a centrifugal fan, a centrifugal fan and a clothing dryer.

BACKGROUND

In a centrifugal fan, according to the principle of converting kinetic energy into potential energy, a high-speed rotating impeller is used to accelerate gas, then decelerate it, change a flow direction thereof, and convert kinetic energy into potential energy (pressure). The centrifugal fans are widely used in ventilation, dust exhausting and cooling of factories, mines, tunnels, cooling towers, vehicles, ships and buildings; ventilation and air introduction of boilers and industrial furnaces; cooling and ventilation in air conditioning equipment and household appliances; drying and selective delivery of grains; inflation and propulsion of air sources of wind tunnels and hovercrafts, etc.

Taking clothing dryers as an example, the fans on existing clothing dryers are generally centrifugal fans. The centrifugal fan includes a drive motor, a housing, and an impeller arranged in the housing. The drive motor can drive the impeller to rotate at a high speed to accelerate the gas. The gas enters from one end of the housing, flows toward the other end, and flows all around after impacting a rear disc of the impeller. Therefore, an air flow volume at an air inlet end of the housing is larger than an air flow volume at the other end of the housing. The air inlet end of the housing is a strong wind end due to the large air flow volume, and the other end of the housing is a weak wind end due to the small air flow volume. However, since a width of an air duct at the strong wind end in the housing is the same as a width of an air duct at the weak wind end, the following situation is likely to occur: it is impossible for the air duct at the weak wind end with a small air flow volume to be fully filled with air flow, and a negative pressure will be generated at the part without air flow, thus causing air flow turbulence, which affects a working efficiency of the centrifugal fan, and further affects a working efficiency of the clothing dryer.

Accordingly, there is a need in the art for a new housing of a centrifugal fan and a corresponding centrifugal fan and clothing dryer to solve the above problem.

SUMMARY

In order to solve the above problem in the prior art, that is, to solve the problem that air flow turbulence is likely to occur in the air duct of the existing centrifugal fan, which would affect the working efficiency of the centrifugal fan, the present disclosure provides a housing of a centrifugal fan, in which an air duct of the housing is provided with a layering structure, the layering structure is arranged to be able to divide at least a part of the air duct into at least two wind layers, and a width of the wind layer close to a strong wind end is larger than a width of the wind layer close to a weak wind end.

In a preferred technical solution of the above housing, the layering structure is arranged close to an outlet end of the air duct.

In a preferred technical solution of the above housing, the layering structure is a layering platform attached to or formed on an inner wall of the housing, and the layering platform divides the air duct into a first wind layer and a second wind layer, in which the first wind layer is close to the strong wind end, and the second wind layer is close to the weak wind end.

In a preferred technical solution of the above housing, a cross-sectional width of the layering platform gradually increases in a direction in which a gas flows toward an outlet end of the air duct.

In a preferred technical solution of the above housing, a windward end of the layering platform has a smooth transition with the inner wall of the housing.

In a preferred technical solution of the above housing, a height of the layering platform gradually decreases in a direction in which a gas flows toward an outlet end of the air duct.

In a preferred technical solution of the above housing, a height of the layering platform gradually decreases in a direction in which a gas flows toward an outlet end of the air duct.

In a preferred technical solution of the above housing, an inner side face of the layering platform is arranged inclined with respect to the inner wall of the housing.

In a preferred technical solution of the above housing, the layering structure is a layering platform attached to or formed on an inner wall of the housing, and the layering platform includes at least two step portions so as to divide the air duct into at least three wind layers.

In a preferred technical solution of the above housing, a cross-sectional width of each of the step portions of the layering platform gradually increases in a direction in which a gas flows toward an outlet end of the air duct.

In a preferred technical solution of the above housing, a windward end of the layering platform has a smooth transition with the inner wall of the housing.

In a preferred technical solution of the above housing, a height of each of the step portions of the layering platform gradually decreases in a direction in which a gas flows toward an outlet end of the air duct.

In a preferred technical solution of the above housing, a height of each of the step portions of the layering platform gradually decreases in a direction in which a gas flows toward an outlet end of the air duct.

In a preferred technical solution of the above housing, the layering structure is a layering platform attached to or formed on an inner wall of the housing, and an inner side face of the layering platform extends obliquely from the inner wall of the housing to a bottom wall of the housing.

In a preferred technical solution of the above housing, a cross-sectional width of the layering platform gradually increases in a direction in which a gas flows toward an outlet end of the air duct.

In a preferred technical solution of the above housing, a windward end of the layering platform has a smooth transition with the inner wall of the housing.

In a preferred technical solution of the above housing, a height of the position where the layering platform intersects with the inner wall of the housing gradually decreases in a direction in which a gas flows toward an outlet end of the air duct.

In a preferred technical solution of the above housing, a height of the position where the layering platform intersects with the inner wall of the housing gradually decreases in a direction in which a gas flows toward an outlet end of the air duct.

In a preferred technical solution of the above housing, the layering structure is fixedly connected to or integrated with an inner wall of the housing.

In a preferred technical solution of the above housing, a height of the layering platform is ½ to ¾ of a height of the inner wall of the housing.

In another aspect, the present disclosure also provides a centrifugal fan, which includes the above housing.

In further another aspect, the present disclosure also provides a clothing dryer, which includes the above centrifugal fan.

It can be understood by those skilled in the art that in the preferred technical solutions of the present disclosure, by arranging a layering structure in the air duct, the air duct is divided into at least two wind layers by the layering structure, and the width of the wind layer close to the strong wind end is larger than the width of the wind layer close to the weak wind end, that is, the width of the air duct at the weak wind end is adjusted through the layering structure so that the width of the air duct at the weak wind end matches the air flow volume at the weak wind end to avoid a situation in which the air duct cannot be fully filled with air flow, thereby avoiding air flow turbulence in the air duct, and further avoiding affecting the working efficiency of the centrifugal fan.

Further, the windward end of the layering platform has a smooth transition with the inner wall of the housing. Through the smooth transition between the windward end and the inner wall of the housing, the air flow on the inner wall of the housing can smoothly transition to the inner side face of the layering platform.

In addition, the centrifugal fan further provided by the present disclosure on the basis of the above technical solutions further has the technical effects of the above housing since the above housing is used in the centrifugal fan. As compared with the centrifugal fan before the improvement, the air duct of the centrifugal fan of the present disclosure hardly has air flow turbulence, and its working efficiency is greatly improved.

BRIEF DESCRIPTION OF DRAWINGS

Preferred embodiments of the present disclosure will be described below with reference to the accompanying drawings, in which.

DETAILED DESCRIPTION

First, it should be understood by those skilled in the art that the embodiments described below are only used to explain the technical principles of the present disclosure, and are not intended to limit the scope of protection of the present disclosure.

It should be noted that in the description of the present disclosure, terms indicating directional or positional relationships, such as "front", "rear", "upper", "middle", "lower", "top", "bottom", "inner", "outer" and the like, are based on the directional or positional relationships shown in the accompanying drawings. They are only used for ease of description, and do not indicate or imply that the device or element must have a specific orientation, or be constructed or operated in a specific orientation. Therefore, they should not be considered as limitations to the present disclosure. In addition, terms "first" and "second" are merely used for description, and should not be construed as indicating or implying relative importance.

In addition, it should also be noted that in the description of the present disclosure, unless otherwise clearly specified and defined, terms "install", "arrange", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem pointed out in the "BACKGROUND OF THE INVENTION" that air flow turbulence is likely to occur in the air duct of the existing centrifugal fan, which would affect the working efficiency of the centrifugal fan, the present disclosure provides a housing of a centrifugal fan, a centrifugal fan and a clothing dryer, aiming at effectively avoiding air flow turbulence in the air duct of the centrifugal fan, and further avoiding affecting the working efficiency of the centrifugal fan.

Figure 1:
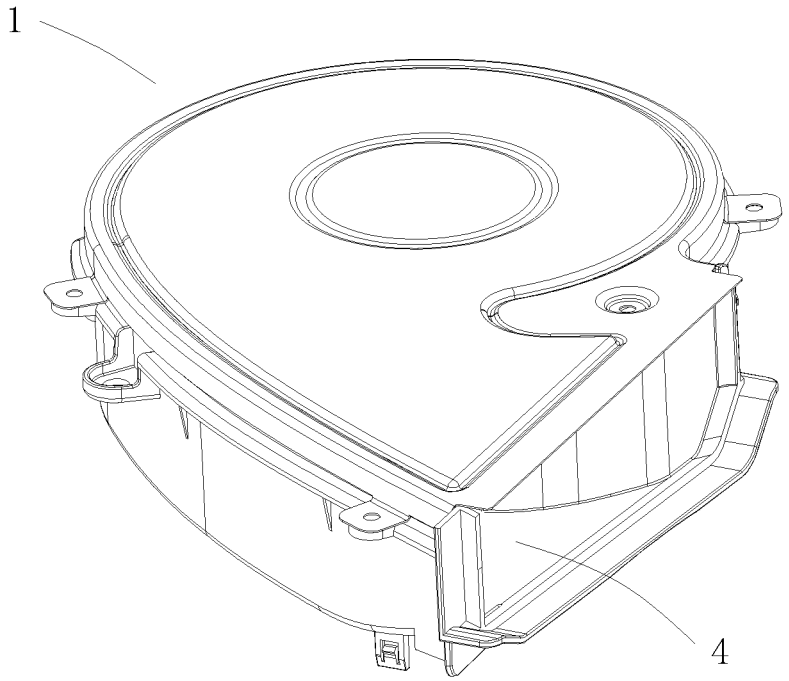
FIG. 1 is a schematic structural view of a centrifugal fan of the present disclosure.

Specifically, as shown in FIG. 1, the centrifugal fan of the present disclosure includes a housing 1, an impeller is provided in the housing 1, and a layering structure is provided in an air duct of the housing 1. The layering structure is arranged to be able to divide at least a part of the air duct into at least two wind layers, and a width of a wind layer close to a strong wind end is larger than a width of a wind layer close to a weak wind end. It can be known from the "BACKGROUND OF THE INVENTION" that since the gas enters from a bottom of the housing 1 and flows upward, it flows all around after impacting a rear disc of the impeller. Therefore, the air flow volume at the top of the housing 1 is larger than the air flow volume at a bottom of the housing 1. The top of the housing 1 is the strong wind end due to the large air flow volume, and the bottom of the housing 1 is the weak wind end due to the small air flow volume. Since the width of the air duct at the strong wind end in the housing 1 (i.e., the top of the housing 1) is the same as the width of the air duct at the weak wind end (i.e., the bottom of the housing 1), the following situation is likely to occur: it is impossible for the air duct at the weak wind end with a small air flow volume to be fully filled with air flow, and a negative pressure will be generated at the part without air flow, thus causing air flow turbulence, which affects a working efficiency of the centrifugal fan. For this reason, a layering structure is provided in the air duct in the present disclosure. The air duct is divided into at least two wind layers by the layering structure, and the width of the wind layer close to the strong wind end is larger than the width of the wind layer close to the weak wind end, that is, the width of the air duct at the weak wind end is adjusted through the layering structure so that the width of the air duct at the weak wind end matches the air flow volume at the weak wind end to avoid a situation in which the air duct cannot be fully filled with air flow. The layering structure and the inner wall of the housing 1 can be fixedly connected or integrated with each other. Those skilled in the art may flexibly set the specific connection form of the layering structure and the inner wall of the housing 1 in practical applications, as long as the layering structure can be fixedly connected to the inner wall of the housing 1. In addition, the layering structure may be arranged in the entire air duct, or the layering structure may be arranged on a certain part of the air duct. In a preferred situation, the layering structure may be arranged close to an outlet end 4 of the air duct, etc. The adjustment and change of the specific arrangement position of the layering structure does not deviate from the principle and scope of the present disclosure, and should be defined within the scope of protection of the present disclosure. It should be pointed out that in this application, that "the layering structure is arranged close to the outlet end of the air duct" includes a case where the layering structure is arranged at the outlet end of the air duct, as well as a case where the layering structure slightly extends into the inside of the air duct, and the specific degree of extension will vary in different application scenes. In principle, the degree of the inward extension of the layering structure in the air flow direction should not exceed a centerline of the impeller.

Hereinafter, the technical solutions of the present disclosure will be described in detail by taking the layering structure provided at the outlet end 4 of the air duct as an example.

First Embodiment

Figure 2:
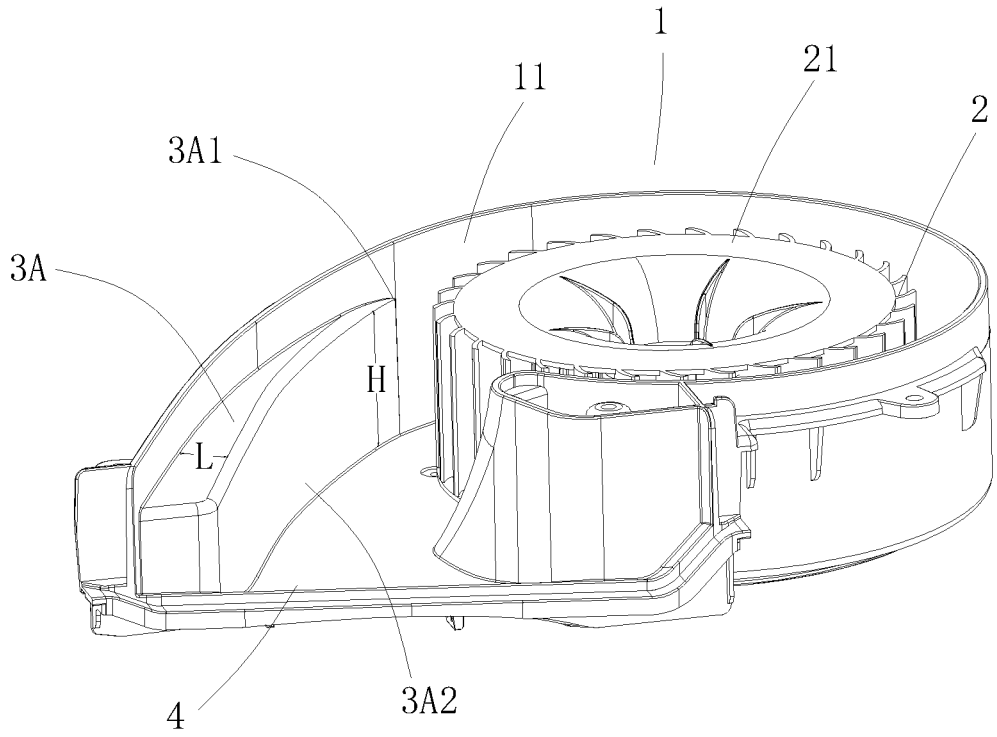
FIG. 2 is a schematic structural view of a first embodiment of the centrifugal fan of the present disclosure.

In the following, the technical solution of the first embodiment of the present disclosure will be described with reference to FIG. 2, in which FIG. 2 is a schematic structural view of the first embodiment of the centrifugal fan of the present disclosure.

As shown in FIG. 2, the centrifugal fan of the present disclosure includes a housing 1, an impeller 2 is provided in the housing 1, and a layering structure is provided in the air duct of the housing 1. The layering structure is a layering platform 3A attached to or formed on an inner wall 11 of the housing 1, and the layering platform 3A divides the air duct into a first wind layer and a second wind layer (upper and lower layers, but not shown in FIG. 2), in which the first wind layer is close to the strong wind end, and the second wind layer is close to the weak wind end. That is, the air duct in the housing 1 is divided into two wind layers by the layering platform 3A, i.e., the first wind layer and the second wind layer. The first wind layer is close to the weak wind end, that is, it is located at the top of the housing 1, and the second wind layer is close to the weak wind end, that is, it is located at the bottom of the housing 1. It can be seen from the above that since the gas enters from the bottom of the housing 1 and flows upward, it flows all around after impacting a rear disc 21 of the impeller. Therefore, the air flow volume at the top of the housing 1 is larger than the air flow volume at the bottom of the housing 1. Therefore, the width of the first wind layer is larger than the width of the second wind layer. The layering platform 3A can be integrally formed with the inner wall 11 of the housing 1, that is, the layering platform 3A is a structure formed on the inner wall 11 of the housing 1, or the layering platform 3A may also be provided as a separate member, which is attached to the inner wall 11 of the housing 1 by adhering, magnetic adsorption or riveting, etc., and those skilled in the art may flexibly set the specific connection form of the layering platform 3A and the inner wall 11 of the housing 1 in practical applications, as long as the layering platform 3A can be fixedly connected to the inner wall 11 of the housing 1. In addition, through repeated tests, the inventor has verified that when the height of the layering platform 3A (H shown in FIG. 2) is ½ to ¾ of the height of the inner wall 11 of the housing 1, air flow turbulence can be better avoided in the air duct. Of course, the scope of protection of the present disclosure is not limited to this. In practical applications, when the height of the layering platform 3A is set to other values, it will also fall within the scope of protection of the present disclosure. In addition, it should be noted that in practical applications, those skilled in the art may divide the air duct in the second wind layer into multiple wind layers according to the distribution of the air flow volume in the air duct. In a preferred situation, an inner side face 3A2 of the layering platform 3A may be arranged inclined with respect to the inner wall 11 of the housing 1 (that is, inclined with respect to the vertical direction), and the layering platform 3A smoothly divides the air duct of the second wind layer into countless smoothly transitioning wind layers.

Preferably, a cross-sectional width of the layering platform 3A gradually increases in a direction in which the gas flows toward the outlet end 4 of the air duct. Since the width of the air duct gradually increases in the direction in which the gas flows toward the outlet end 4 of the air duct, in order to ensure that the width of the second wind layer matches the air flow volume of the second wind layer, the cross-sectional width of the layering platform 3A (L shown in FIG. 2) also gradually increases in the direction in which the gas flows toward the outlet end 4 of the air duct.

Preferably, a windward end 3A1 of the layering platform 3A has a smooth transition with the inner wall 11 of the housing 1. By making the windward end 3A1 have a smooth transition with the inner wall 11 of the housing 1, the air flow on the inner wall 11 of the housing 1 can be smoothly transitioned to the inner side face 3A2 of the layering platform 3A.

Preferably, the height of the layering platform 3A gradually decreases in the direction in which the gas flows toward the outlet end 4 of the air duct. The height of the layering platform 3A refers to H in FIG. 2, and the value of H gradually decreases from the windward end 3A1 of the layering platform 3A in the direction in which the gas flows toward the outlet end 4 of the air duct.

Second Embodiment

Figure 3:
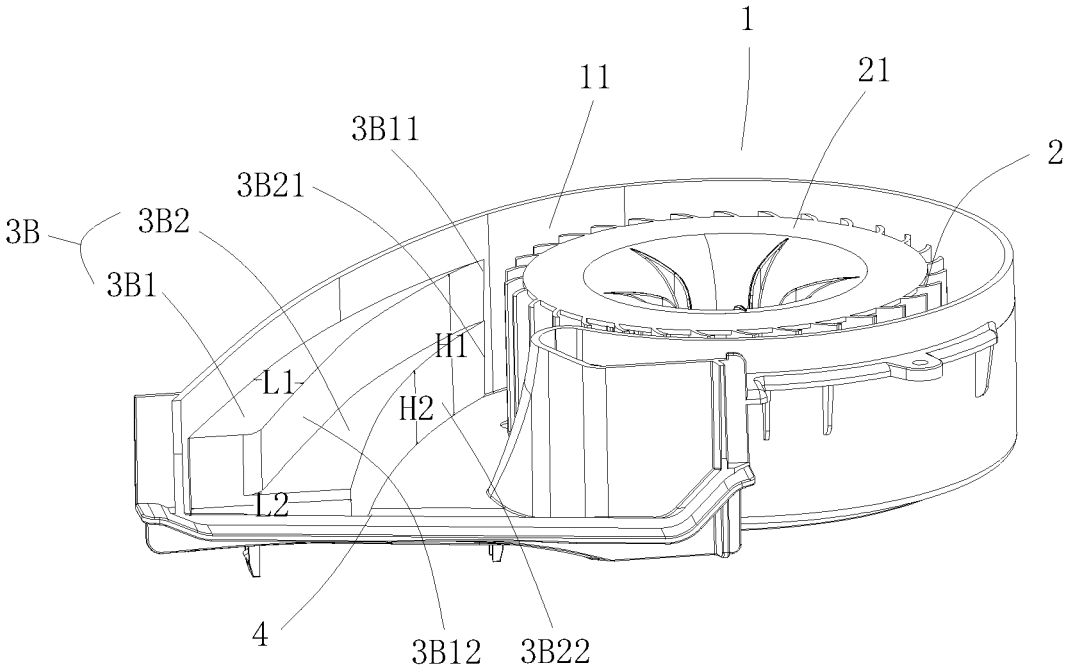
FIG. 3 is a schematic structural view of a second embodiment of the centrifugal fan of the present disclosure.

The technical solution of the second embodiment of the present disclosure will be described below with reference to FIG. 3, in which FIG. 3 is a schematic structural view of the second embodiment of the centrifugal fan of the present disclosure.

As shown in FIG. 3, the centrifugal fan of the present disclosure includes a housing 1, an impeller 2 is provided in the housing 1, and a layering structure is provided in the air duct of the housing 1. The layering structure is a layering platform 3B attached to or formed on an inner wall 11 of the housing 1, and the layering platform 3B includes two step portions so as to divide the air duct into three wind layers. The layering platform 3B includes a first step portion 3B1 and a second step portion 3B2. The air duct is divided into three wind layers by the first step portion 3B1 and the second step portion 3B2, i.e., an upper wind layer, a middle wind layer and a lower wind layer. The upper wind layer is close to the strong wind end, that is, it is located at the top of the housing 1, the lower wind layer is close to the weak wind end, that is, it is located at the bottom of the housing 1, and the middle wind layer is located between the upper wind layer and the lower wind layer. It can be seen from the above that since the gas enters from the bottom of the housing 1 and flows upward, it flows all around after impacting a rear disc 21 of the impeller. Therefore, the air flow volume at the top of the housing 1 is larger than the air flow volume at the bottom of the housing 1. Therefore, the width of the upper wind layer is larger than the width of the lower wind layer, and the width of the middle wind layer is larger than the width of the lower wind layer and smaller than the width of the upper wind layer. Of course, the layering platform 3B is not limited to two step portions, that is, the air duct is not limited to three wind layers. In practical applications, those skilled in the art may flexibly set the specific number of wind layers in the air duct according to the specific distribution of the air flow volumes in the air duct, as long as the air flow turbulence can be avoided in the air duct. The layering platform 3B may be integrally formed with the inner wall 11 of the housing 1, that is, the layering platform 3B is a structure formed on the inner wall 11 of the housing 1, or the layering platform 3B may also be provided as a separate member, which is attached to the inner wall 11 of the housing 1 by adhering, magnetic adsorption or riveting, etc., and those skilled in the art may flexibly set the specific connection form of the layering platform 3B and the inner wall 11 of the housing 1 in practical applications, as long as the layering platform 3B can be fixedly connected to the inner wall 11 of the housing 1.

Preferably, as shown in FIG. 3, a cross-sectional width of each of the step portions of the layering platform 3B gradually increases in a direction in which the gas flows toward the outlet end 4 of the air duct. Since the width of the air duct gradually increases in the direction in which the gas flows toward the outlet end 4 of the air duct, in order to ensure that the width of the middle wind layer matches the air flow volume of the middle wind layer, the cross-sectional width of the first step portion 3B1 (L1 shown in FIG. 3) also gradually increases in the direction in which the gas flows toward the outlet end 4 of the air duct. Similarly, in order to ensure that the width of the lower wind layer matches the air flow volume of the lower wind layer, the cross-sectional width of the second step portion 3B2 (L2 shown in FIG. 3) also gradually increases in the direction in which the gas flows toward the outlet end 4 of the air duct.

Preferably, a windward end of the layering platform 3B has a smooth transition with the inner wall 11 of the housing 1. That is, a windward end 3B11 of the first step portion 3B1 has a smooth transition with the inner wall 11 of the housing 1. By making the windward end 3B11 of the first step portion 3B1 have a smooth transition with the inner wall 11 of the housing 1, the air flow on the inner wall 11 of the housing 1 can be smoothly transitioned to an inner side face 3B12 of the first step portion 3B1. Similarly, a windward end 3B21 of the second step portion 3B2 has a smooth transition with the inner wall 11 of the housing 1. By making the windward end 3B21 of the second step portion 3B2 have a smooth transition with the inner wall 11 of the housing 1, the air flow on the inner wall 11 of the housing 1 can be smoothly transitioned to an inner side face 3B22 of the second step portion 3B2.

Preferably, the height of each of the step portions of the layering platform 3B gradually decreases in the direction in which the gas flows toward the outlet end 4 of the air duct. The height of the first step portion 3B1 refers to H1 in FIG. 3, and the value of H1 gradually decreases from the windward end 3B11 of the first step portion 3B1 in the direction in which the gas flows toward the outlet end 4 of the air duct. The height of the second step portion 3B2 refers to H2 in FIG. 3, and the value of H2 gradually decreases from the windward end 3B21 of the second step portion 3B2 in the direction in which the gas flows toward the outlet end 4 of the air duct.

Third Embodiment

Figure 4:
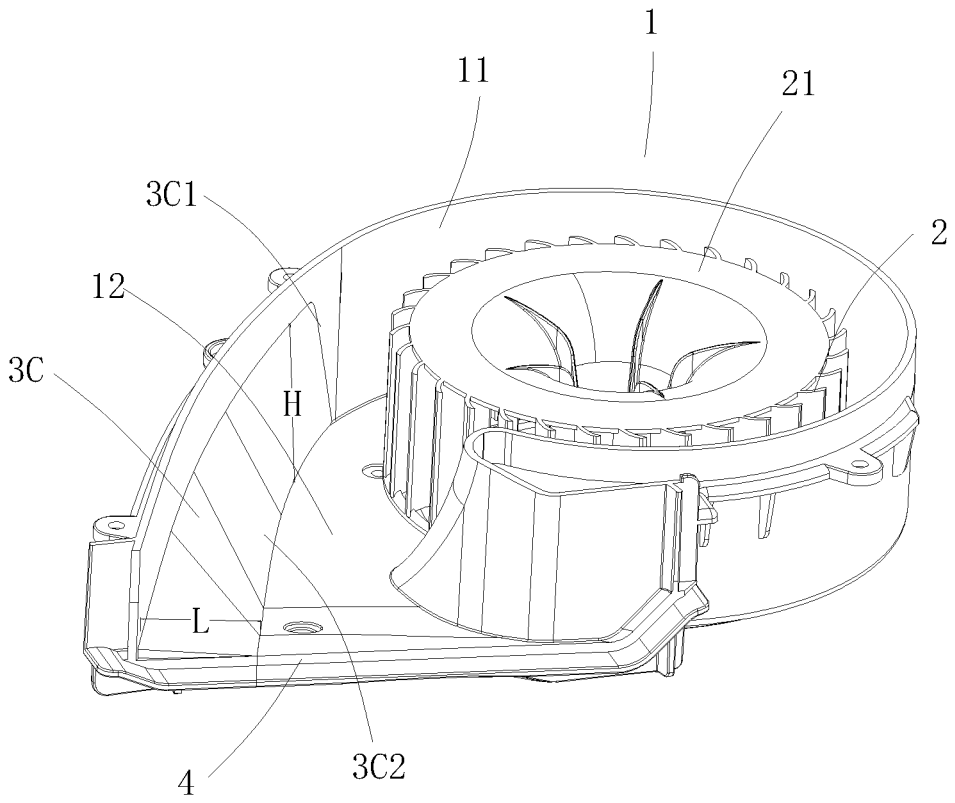
FIG. 4 is a schematic structural view of a third embodiment of the centrifugal fan of the present disclosure.

In the following, the technical solution of the third embodiment of the present disclosure will be described with reference to FIG. 4, in which FIG. 4 is a schematic structural view of the third embodiment of the centrifugal fan of the present disclosure.

As shown in FIG. 4, the centrifugal fan of the present disclosure includes a housing 1, an impeller 2 is provided in the housing 1, and a layering structure is provided in the air duct of the housing 1. The layering structure is a layering platform 3C attached to or formed on an inner wall 11 of the housing 1, and an inner side face 3C2 of the layering platform 3C extend obliquely from the inner wall 11 of the housing 1 to a bottom wall 12 of the housing 1. That is, the layering platform 3C smoothly divides the air duct into countless smoothly transitioning wind layers. It can be seen from the above that since the gas enters from the bottom of the housing 1 and flows upward, it flows all around after impacting a rear disc 21 of the impeller. Therefore, the air flow volume at the top of the housing 1 is larger than the air flow volume at the bottom of the housing 1. Therefore, the width of the wind layer close to the strong wind end (which is located at the top of the housing 1) is larger than the width of the wind layer close to the weak wind end (which is located at the bottom of the housing 1). The layering platform 3C can be integrally formed with the inner wall 11 of the housing 1, that is, the layering platform 3C is a structure formed on the inner wall 11 of the housing 1, or the layering platform 3C may also be provided as a separate member, which is attached to the inner wall 11 of the housing 1 by adhering, magnetic adsorption or riveting, etc., and those skilled in the art may flexibly set the specific connection form of the layering platform 3C and the inner wall 11 of the housing 1 in practical applications, as long as the layering platform 3C can be fixedly connected to the inner wall 11 of the housing 1.

Preferably, as shown in FIG. 4, a cross-sectional width of the layering platform 3C gradually increases in a direction in which the gas flows toward the outlet end 4 of the air duct. Since the width of the air duct gradually increases in the direction in which the gas flows toward the outlet end 4 of the air duct, in order to ensure that the width of each wind layer can match the air flow volume of this wind layer, the cross-sectional width of the layering platform 3C (L shown in FIG. 4) also gradually increases in the direction in which the gas flows toward the outlet end 4 of the air duct.

Preferably, as shown in FIG. 4, a windward end 3C1 of the layering platform 3C has a smooth transition with the inner wall 11 of the housing 1. By making the windward end 3C1 have a smooth transition with the inner wall 11 of the housing 1, the air flow on the inner wall 11 of the housing 1 can be smoothly transitioned to the inner side face 3C2 of the layering platform 3C.

Preferably, as shown in FIG. 4, the height of the position where the layering platform 3C intersects with the inner wall 11 of the housing 1 (or the line where the inner side face 3C2 intersects with the inner wall 11) gradually decreases in the direction in which the gas flows toward the outlet end 4 of the air duct. More specifically, the height of the position where the layering platform 3C intersects with the inner wall 11 refers to H in FIG. 4, and the value of H gradually decreases from the windward end 3C1 of the layering platform 3C in the direction in which the gas flows toward the outlet end 4 of the air duct.

Finally, the present disclosure also provides a clothing dryer, which includes the centrifugal fan of the first embodiment, the second embodiment, or the third embodiment.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A housing of a centrifugal fan, comprising:

an air duct of the housing is-provided with a layering structure, wherein the layering structure is arranged to be able to divide at least a part of the air duct into at least two wind layers, and a width of the wind layer close to a strong wind end is larger than a width of the wind layer close to a weak wind end:

wherein the layering structure is arranged close to an outlet end of the air duct;

wherein the layering structure is a layering platform attached to or formed on an inner wall of the housing, and the layering platform divides the air duct into a first wind layer and a second wind layer, and wherein the first wind layer is close to the strong wind end, and the second wind layer is close to the weak wind end;

wherein a windward end of the layering platform has a smooth transition with the inner wall of the housing; and wherein a cross-sectional width of the layering platform gradually increases in a direction in which a gas flows from the windward end toward an outlet end of the air duct.

2. The housing according to claim 1, wherein a height of the layering platform gradually decreases in a direction in which a gas flows toward an outlet end of the air duct.

3. The housing according to claim 1, wherein a height of the layering platform gradually decreases in a direction in which a gas flows toward an outlet end of the air duct.

4. The housing according to claim 1, wherein an inner side face of the layering platform is arranged inclined with respect to the inner wall of the housing.

5. A housing of a centrifugal fan, comprising:

an air duct of the housing provided with a layering structure, wherein the layering structure is arranged to be able to divide at least a part of the air duct into at least two wind layers, and a width of the wind layer close to a strong wind end is larger than a width of the wind layer close to a weak wind end;

wherein the layering structure is arranged close to an outlet end of the air duct;

wherein the layering structure is a layering platform attached to or formed on an inner wall of the housing, and the layering platform comprises at least two step portions so as to divide the air duct into at least three wind layers;

wherein a windward end of the layering platform has a smooth transition with the inner wall of the housing; and wherein a cross-sectional width of each of the step portions of the layering platform gradually increases in a direction in which a gas flows from the windward end toward an outlet end of the air duct.

6. The housing according to claim 5, wherein a height of each of the step portions of the layering platform gradually decreases in a direction in which a gas flows toward an outlet end of the air duct.

7. The housing according to claim 5, wherein a height of each of the step portions of the layering platform gradually decreases in a direction in which a gas flows toward an outlet end of the air duct.

8. The housing according to claim 1, wherein the layering structure is a layering platform attached to or formed on an inner wall of the housing, and an inner side face of the layering platform extends obliquely from the inner wall of the housing to a bottom wall of the housing.

9. The housing according to claim 8, wherein a cross-sectional width of the layering platform gradually increases in a direction in which a gas flows toward an outlet end of the air duct.

10. The housing according to claim 8, wherein a windward end of the layering platform has a smooth transition with the inner wall of the housing.

11. The housing according to claim 8, wherein a height of the position where the layering platform intersects with the inner wall of the housing gradually decreases in a direction in which a gas flows toward an outlet end of the air duct.

12. The housing according to claim 10, wherein a height of the position where the layering platform intersects with the inner wall of the housing gradually decreases in a direction in which a gas flows toward an outlet end of the air duct.

13. The housing according to claim 1, wherein the layering structure is fixedly connected to or integrated with an inner wall of the housing.

14. The housing according to claim 1, wherein a height of the layering platform is ½ to ¾ of a height of the inner wall of the housing.

* * * * *